US005890485A

United States Patent [19]

Shimek et al.

[11] Patent Number: 5,890,485

[45] Date of Patent: Apr. 6, 1999

[54] DANCING FLAME CONTROL SYSTEM FOR GAS FIREPLACES

[75] Inventors: Ronald John Shimek, Prior Lake; Daniel Curtis Shimek, Apple Valley; David Charles Lyons, Red Wing, all of Minn.

[73] Assignee: Heat-N-Glo Fireplace Products, Inc., Savage, Minn.

[21] Appl. No.: 701,353

[22] Filed: Sep. 27, 1996

[51] Int. Cl.[6] ..... F23C 1/18; F23N 5/24

[52] U.S. Cl. ..... 126/512; 126/503; 126/92 R; 126/85 R; 431/1; 431/125; 431/18; 431/37

[58] Field of Search ..... 126/512, 42 R, 126/503, 85 R; 431/1, 125, 126, 349, 355, 8, 37, 18

[56] References Cited

U.S. PATENT DOCUMENTS 3,623,470 11/1971 Wilholte ..... 126/92 R X
3,817,686 6/1974 Quittner ..... 431/125
5,000,162 3/1991 Shimek et al. ..... 126/512
5,032,766 7/1991 Gundlach et al. ..... 315/150
5,081,981 1/1992 Beal ..... 126/92 R
5,092,312 3/1992 Zolow ..... 126/500
5,391,074 2/1995 Meeker ..... 431/6

*Primary Examiner*—Larry Jones
*Attorney, Agent, or Firm*—John B. Sowell

[57] ABSTRACT

A novel control system for altering a fixed pattern of gas flames in a fireplace having artificial logs comprises a log set having a burner system and the burner system having a gas valve control which is coupled to source of gas or air to be regulated. The control system has a valve which controls the air or gas being supplied to the burner and a control sensor is coupled to the control system for activating the time sequence of the cycle of the control system so as to raise or lower the gas flames being regulated and to disturb the pattern of gas flames to produce the effect of dancing flames.

18 Claims, 4 Drawing Sheets

DANCING FLAME CONTROL SYSTEM FOR GAS FIREPLACES

BACKGROUND OF THE INVENTION

1. Field of the Invention

The present invention relates to gas burners for gas fireplaces. More particularly, the present invention relates to a system for controlling a gas used in combustion to affect the disturbance of the gas flame pattern of gas burner system.

2. Description of the Prior Art

It is well known that candles will flicker when the air around the burning flame is disturbed. It is also well known that a closed fireplace having closed doors across the front of the gas fireplace displays little or no flicker until the doors are opened and a draft or excess combustion air is drawn into the combustion system. A natural fire of wood logs in a closed door fireplace displays a noticeable disturbance of the pattern of flames even when the doors of the fireplace remain closed.

It would be desirable to emulate the changes of the flame pattern of a natural wood burning fireplace by changing a fixed flame pattern of an artificial gas log fireplace.

SUMMARY OF THE INVENTION

It is a principal object of the present invention to provide a control system for controlling a disturbance of gas flames in a gas log fireplace system.

It is a principal object of the present invention to provide a system for controlling the amount of gas being supplied to a gas log system to effect and disturb the flame pattern.

It is a principal object of the present invention to provide a control system for controlling a valve or valves in response to a predetermined stimulus so as to effect the flame pattern of a gas log system.

It is a principal object of the present invention to provide a low cost and reliable control system for generating flames which dance and change according to a random or predetermined sensed condition in a fireplace system.

In accordance with these and other objects of the present invention there is provided a gas fireplace with a gas burner system of the type that burns a mixture of air and gaseous fuel. A control system is provided having a pneumatic or electrical actuator such as a solenoid valve which is interposed in a neat gas fuel line or an air line. The valve is then moved by a sensor control or a timer to effect movement of the gas flames to provide a dancing flame response.

DETAILED DESCRIPTION OF THE PREFERRED EMBODIMENT

Figure 1:
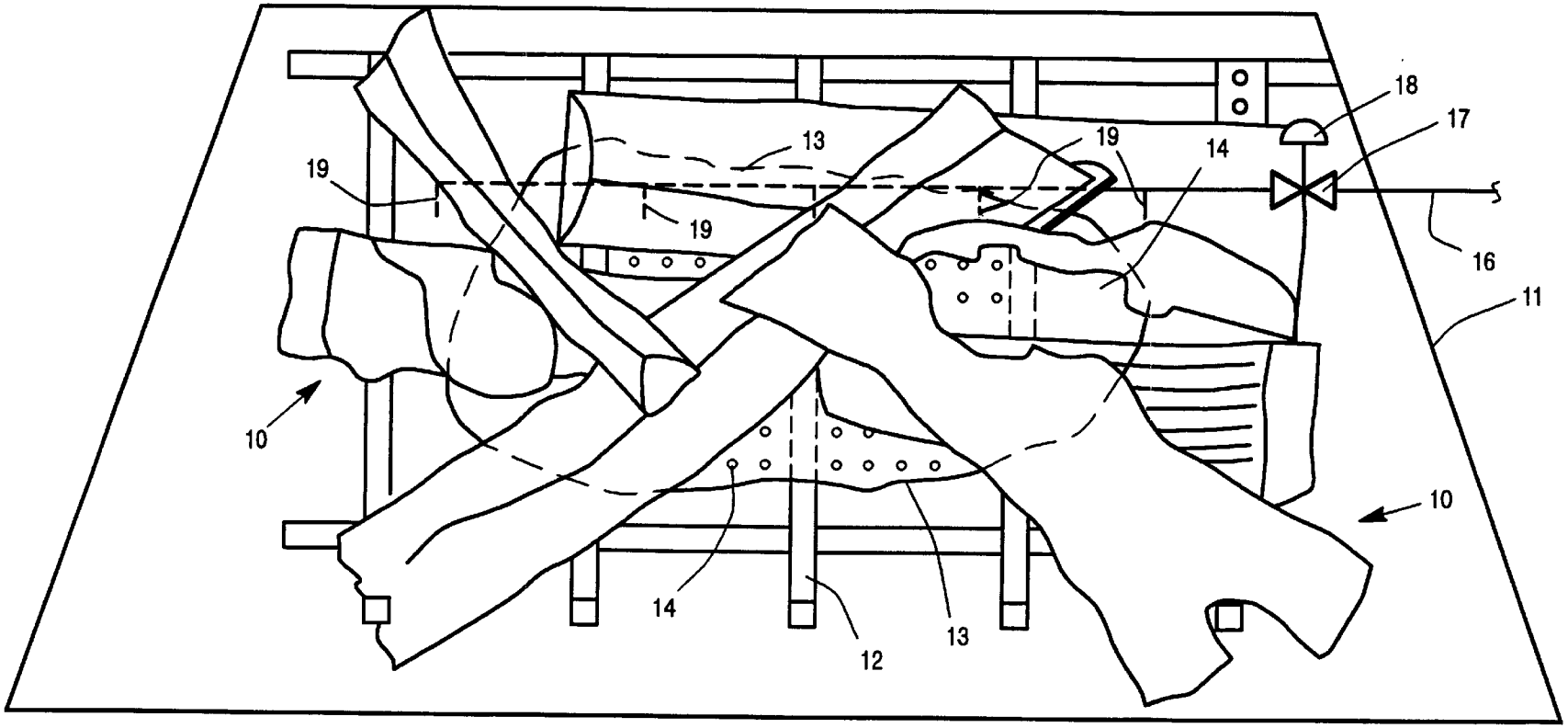
FIG. 1 is a plan view of an artificial gas log fireplace set positioned over a ceramic burner showing the position of a dancing flame control system.

Refer now to FIG. 1 showing a plan view of an artificial gas log fireplace system 10 which is positioned inside of a combustion chamber 11 and generally supported on a grate system 12 positioned over a ceramic burner system 13. The ceramic burner system 13 is shown having flame aperture jets 14 which provide flames in and around the log system 10. There is further shown an air line 16 connected to a control valve 17 shown controlled by a solenoid 18 to affect the amount of air supplied to the air jets 19. It will be understood that the air jets are provided in FIG. 1 by flexible metal tubing which can be bent and directed to the flame areas so as to effect the length and stability of the flames in manner which will cause dancing flames when excess air is provided through the valve 17 in response to several types of control which will be explained in greater detail hereinafter. Further, excess air may be provided by ducts or plenums or divertors moved by the air supply.

Figure 2:
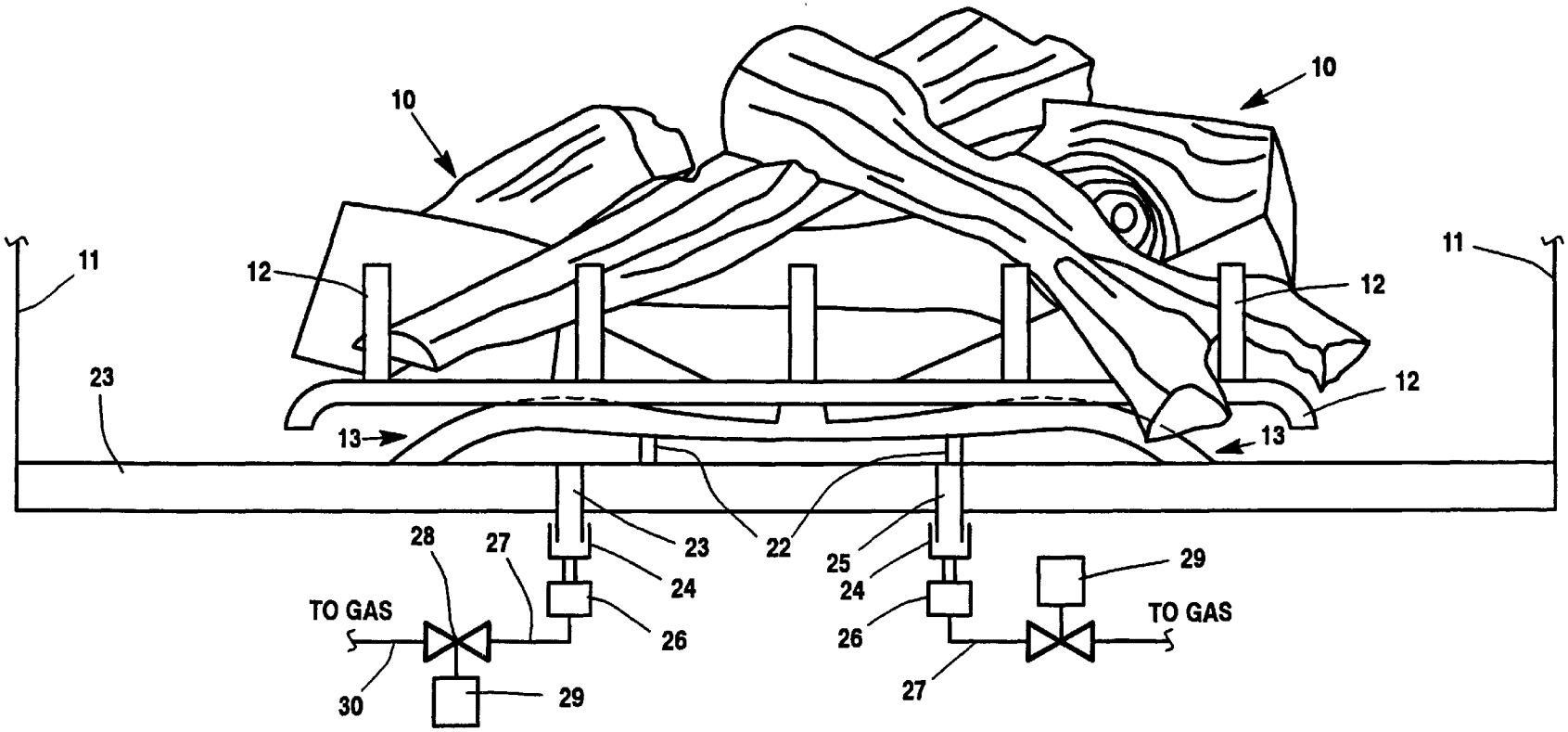
FIG. 2 is an elevation and partial section of an artificial gas log fireplace set positioned over a ceramic burner showing two positions of another dancing flame control system.

Refer now to FIG. 2 showing an elevation in partial section of the artificial gas log system 10 positioned over the ceramic burner system 13 while being supported on a grate 12. The ceramic burner system is shown having a hollow or open chamber 21 which is generally supported by columns 22 and made integral with the floor pan 23 of the combustion chamber 11. There is shown a shutter or air fuel mixing valve 24 connected to a supply connector 25 which terminates inside of the chamber 21. An orifice 26 is connected to a gas supply line 27 which is connected to a gas valve 28 regulated by a solenoid regulator 29. It will be understood that the gas supply to the chamber 21 may be either regulated as to pressure or regulated as to flow by the control valve 28, 29. Since the chamber 21 is relatively large, it is possible to have two such control systems connected to different portions of the ceramic burner systems so as to effect slightly different patterns in the dancing flames emanating from the burner system 13.

Figure 3:
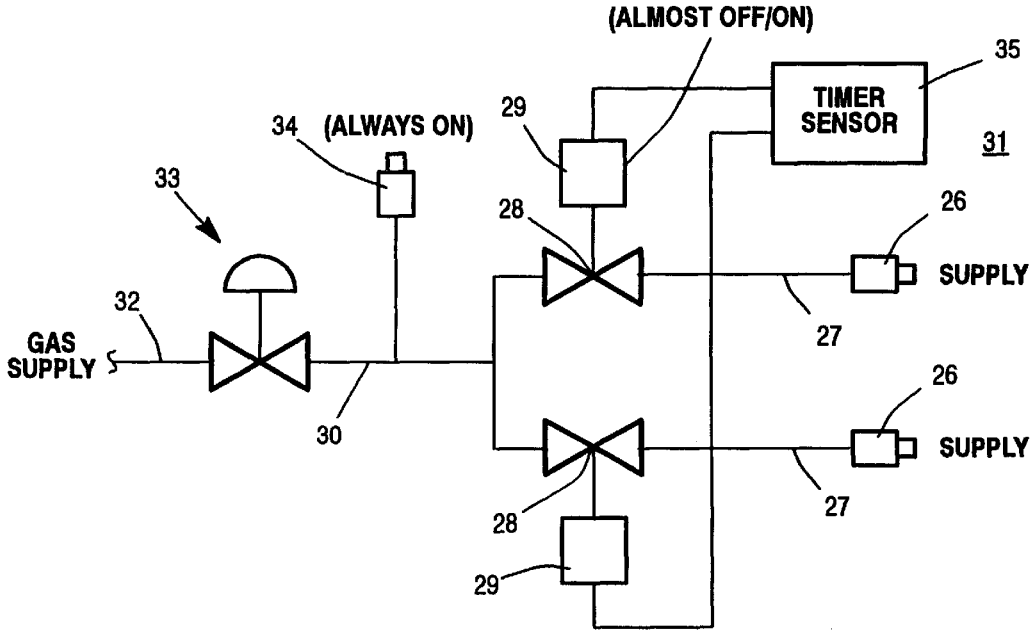
FIG. 3 is a schematic drawing of a valve control system having solenoids or actuators for controlling gas supply to a burner system with a timer or sensor.

Refer now to FIG. 3 showing a schematic drawing of a valve control system 31. This control system comprises a pressure regulator valve 33 which is connected to the gas supply and produces the regulated gas supply on line 27. The regulated gas supply on line 27 can be provided to a part of the burner system that is always on as shown at orifice 34. In the preferred embodiment of the present invention, the supply line 27 is connected to a pair of control valves 28 that are controlled by solenoids 29. The solenoids 29 are preferably toggled alternately in an off and on state by the timer 35. However, the timer may be so arranged that the linear transducer solenoid valve can be slowly opened while the other is slowly closed. The output from the valves on each line 27 is coupled to a respective orifice 26 for the input into line 25 as shown in FIG. 2.

Figure 4:
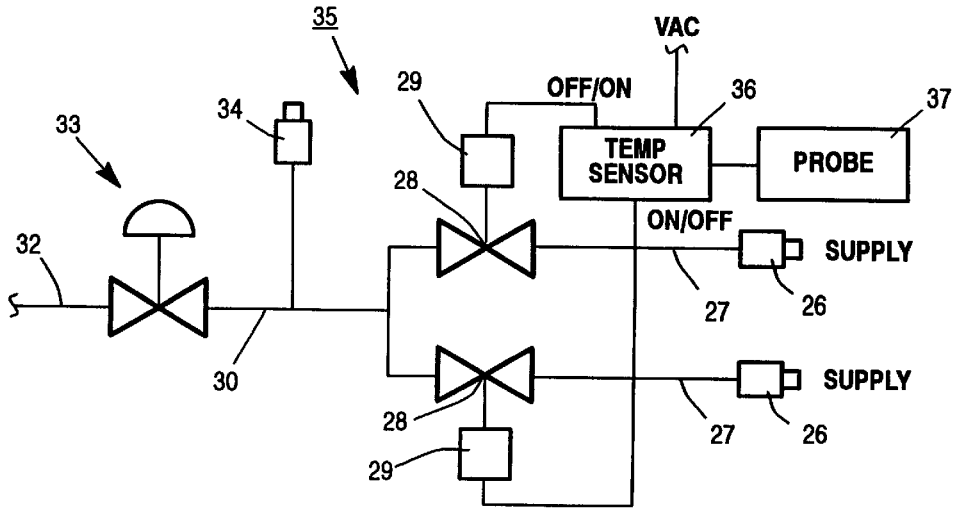
FIG. 4 is a schematic drawing of a valve control system having solenoids or actuators for controlling gas supply to a burner system with a temperature sensor.

Refer now to FIG. 4 showing a schematic drawing of a valve control system 35 which may be employed to regulate a pair of valves 28 employing a temperature sensor 36 and probe 37. The numbers employed to describe the elements of FIG. 4 are the same as those employed to describe the elements in FIG. 3 and are numbered the same. Additional description of these elements is not required.

Figure 5:
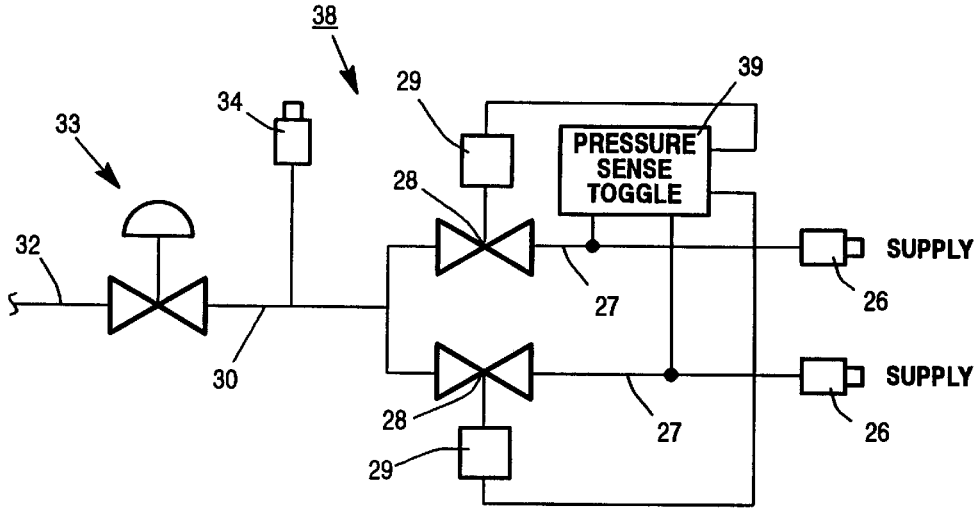
FIG. 5 is a schematic drawing of a valve control system having solenoids or actuators for controlling gas supply to a burner system with a pressure sensor.

Refer now to FIG. 5 showing a schematic drawing of a valve control system 38 which is basically the same as the input portion of the valve control systems of FIGS. 3 and 4 and employ the same numbers for the same elements. In FIG. 4 the valve control system has a differential pressure sensing actuator 39 which is connected to the solenoids 29 and also connected to the output gas lines 27 so as to toggle or change the pressure of one line 27 in high state while the pressure on the other line 27 is in the low state. Once a predetermined threshold pressure is sensed, the toggle reverses and the pressure on the low pressure line increases until the threshold is again reached and the toggle repeats itself. This type system may be employed by slowly bleeding gas to the pressure sensor or a delay or time element may be effected by other means.

Figure 6:
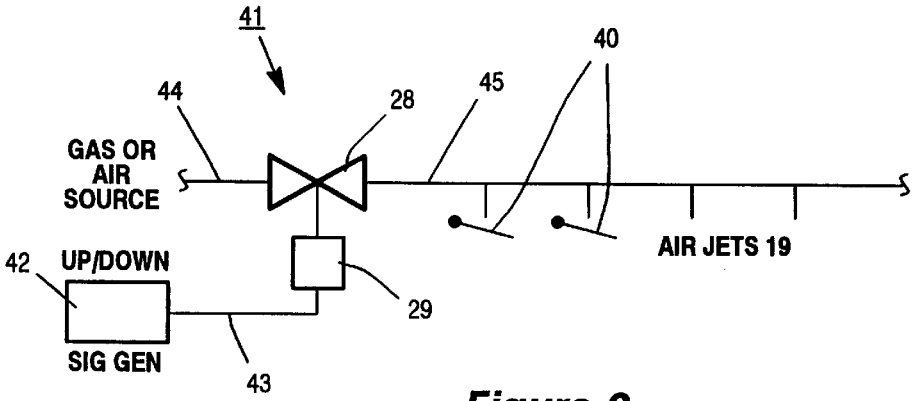
FIG. 6 is a schematic drawing of a valve control system having solenoids or actuators for controlling gas supplied to a burner system with a signal generator.

Refer now to FIG. 6 showing a schematic drawing of a valve control system 41 which comprises an up down counter 42 that incorporates a digital to analog converter so as to generate the equivalent of a sinusoidal or up and down signal on output line 43 to a solenoid 29 which controls valve 28. The valve 28 may be placed in either a gas or an air line so as to supply either an on/off condition of jets of an on/off condition of varying pressure gas on output line 42. Jets 19 may be provided with flexible shutters 40 for producing a random supply of air or gas which eliminates the need for solenoids 29 and the electrical controls.

Figure 7:
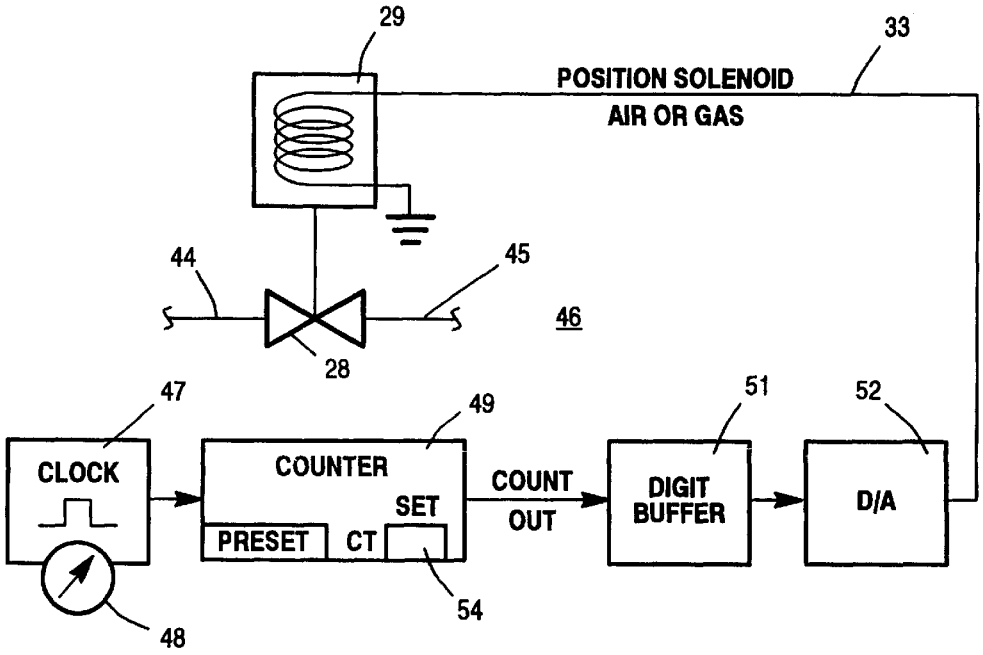
FIG. 7 is a schematic block diagram showing a manually adjustable timer for controlling air or gas.

Refer now to FIG. 7 showing a schematic block diagram of a manually adjustable valve control system 46. The control system 46 comprises a clock generator 47 having adjustment means 48. The output of the clock generator 47 is applied to a counter 49 which produces a digital output value to a digital buffer 51. The digital value stored in buffer 51 is converted to an analog value on output line 53 which is applied to the solenoid 29 of the control valve 28. The counter 49 is also supplied with a set count output at output 54 which may be used as a reset valve input to the counter 49 to reset the counter 49 and start the operation all over again. Thus, the control valve 28 goes through a control operation until the counter reaches a reset value and suddenly the reset counter resets back to a predetermined value which is applied to the solenoid 29 and the operation starts anew.

Having explained a preferred operation of a control valve system and several modifications thereof, it will be appreciated and understood that there are basically two economical values which may be controlled that affect the flames of a burner system. Either the gas supply which is a regulated gas supply may be varied in pressure so as to effect a dancing flame effect or alternatively the excess air which is introduced near or around the substantially fixed burner flames may be altered and made to appear either longer or shorter by introducing excess air into the burner system near the flames.

Having explained three specific control systems and two generic systems, it will be appreciated that the present invention may be incorporated into new burner systems or existing burner systems to effect the desired results of dancing flames without departing from the scope of the present invention.

What is claimed is:

1. A control system for alternating a fixed pattern of flames in a fireplace with artificial logs, comprising:

a fireplace having a log set with a gas burner system, a dancing flame control system, said control system having valve means coupled to a source of a gas to be regulated, said control system having cycle control means coupled to said valve means, and means for adjusting the time sequence of the cycle of said control means to raise or lower the gas value being regulated to alternate the pattern of gas flames in said burner system.

2. A control system as set forth in claim 1 wherein said fireplace log set comprises a burner element located below said log set, and said cycle control means cycles an electrically operated valve.

3. A control system as set forth in claim 2 wherein said electrically operated valve comprises a solenoid.

4. A control system as set forth in claim 3 wherein said cycle control means comprises a timer coupled to said solenoid.

5. A control system as set forth in claim 3 wherein said cycle control means comprises a signal generator coupled to said solenoid for positioning said valve means.

6. A control system as set forth in claim 3 wherein said cycle control means comprise temperature sensing means coupled to said solenoid.

7. A control system as set forth in claim 3 wherein said cycle control means comprises a pressure sensor coupled to said solenoid.

8. A control system as set forth in claim 3 wherein said cycle control means comprises a clock generator coupled to a counter for generating digital values of voltage to be applied to said solenoid, and digital to analog conversion means coupled to said counter and to said solenoid.

9. A control system as set forth in claim 1 wherein said valve means is coupled to a source of combustion air, and air jet means coupled to the output of said valve means for supplying jets of combustion air that disturb the pattern of the gas flames in said burner system.

10. A control system as set forth in claim 1 wherein said valve means is coupled to a source of neat combustion gas.

11. A control system as set forth in claim 1 wherein said valve means is coupled to a source of combustion gas mixed with combustion air.

12. A control system as set forth in claim 1 wherein said valve means is coupled to a gas mixing valve, and said burner system is coupled to said mixing valve.

13. A control system as set forth in claim 12 wherein said gas mixing valve is coupled to a hollow chamber in a gas burner of said burner system, and apertures in said gas burner for generating dancing flames in response to said control system.

14. A method of alternating a fixed pattern of flames in a fireplace with artificial logs, comprising the steps of:

providing an auxiliary flame control system comprising a cycle control coupled to control means for controlling an air or gas supply, coupling said control means to a source which supplies air or gas to a fireplace burner system, coupling actuation means to said cycle control means, and cycling said actuation means to cause movement of said cycle control means and a disturbance to said fixed pattern of said gas flames.

15. A method as set forth in claim 14 wherein the steps of coupling said control means to a source of air or gas comprises inserting said control means in a gas line and comprise the step of controlling the amount of gas being supplied to said fireplace burner system.

16. A method as set forth in claim 14 wherein the step of coupling said control means to a source of air or gas comprises inserting control valve means in an air line and comprises the step of controlling the amount of air being supplied to said fireplace burner system.

17. A method as set forth in claim 14 wherein the step of coupling said actuation means to said cycle control means comprises coupling a variable electrical signal to said cycle control means.

18. A control system for altering a fixed pattern of flames in a fireplace with artificial logs, comprising:

a fireplace having a log set with a burner system, a dancing flame control system, said control system having valve means coupled to a source of a gas to be regulated, said control system having cycle control means coupled to said valve means, said valve means being coupled to a source of combustion air, air jet means coupled to the output of said valve means for supplying jets of combustion air that disturb the pattern of the gas flames in said burner system, and means for adjusting the time sequence of the cycle of said control means to disturb the pattern of gas flames in said burner system.

* * * * *